US005896753A

United States Patent [19]

Kwak et al.

[11] Patent Number: 5,896,753

[45] Date of Patent: Apr. 27, 1999

[54] FREEZING CYCLE APPARATUS HAVING QUICK FREEZING AND THAWING FUNCTIONS

[75] Inventors: Tae-Hee Kwak, Seoul; Kyung-Sik Kim, Inchon; Jin-Koo Park, Seoul, all of Rep. of Korea

[73] Assignee: LG Electronics Inc., Rep. of Korea

[21] Appl. No.: 08/951,178

[22] Filed: Oct. 15, 1997

[30] Foreign Application Priority Data

Oct. 18, 1996 [KR] Rep. of Korea ..... 96-46672
Jan. 15, 1997 [KR] Rep. of Korea ..... 97-1006

[51] Int. Cl.[6] ..... F25D 11/02; F25D 13/02; F25B 13/00

[52] U.S. Cl. ..... 62/441; 62/442; 62/498; 62/324.3

[58] Field of Search ..... 62/324.3, 478, 62/331, 89, 407, 408, 441, 324.1, 442

[56] References Cited

U.S. PATENT DOCUMENTS

| | | | |
|---|---|---|---|
| 3,078,689 | 2/1963 | Japhet | 62/324.3 |
| 3,105,365 | 10/1963 | Harris et al. | 62/324.3 |
| 3,978,684 | 9/1976 | Taylor | 62/324.3 |
| 4,326,390 | 4/1982 | Brooks | 62/382 |
| 5,326,578 | 7/1994 | Yun | 426/231 |
| 5,388,427 | 2/1995 | Lee | 62/331 |
| 5,411,328 | 5/1995 | You | 312/405 |

*Primary Examiner*—William Doerrler
*Attorney, Agent, or Firm*—Ostrolenk, Faber, Gerb & Soffen, LLP

[57] ABSTRACT

A freezing cycle apparatus having quick freezing and thawing functions which is capable of implementing a quick freezing function of foods using an auxiliary evaporator installed in a freezing cycle apparatus, dividing a freezing chamber of the refrigerator into a quick freezing chamber and a common refreezing chamber, and using the thusly divided quick freezing chamber. The apparatus includes a compressor, a three-way valve connected with one end of the compressor, a main evaporator connected with one end of the three-way valve, a phase separator connected with one end of the main evaporator, a first capillary tube connected with one end of the phase separator, a first check valve connected with one end of the first capillary tube, a common freezing unit one end of which is connected with the first check value and the other end of which is connected with the other end of the compressor, which is comprised of a main evaporator, and a quick freezing and thawing function unit connected with the common freezing unit and including an auxiliary heat exchanger, a plurality of capillary tubes, an opening/closing valve, and a check valve.

10 Claims, 8 Drawing Sheets

FREEZING CYCLE APPARATUS HAVING QUICK FREEZING AND THAWING FUNCTIONS

BACKGROUND OF THE INVENTION

1. Field of the Invention

The present invention relates to a freezing cycle apparatus having quick freezing and thawing functions, and in particular to an improved freezing cycle apparatus having quick freezing and thawing functions by which it is possible to selectively use a function between a quick freezing function and a quick thawing function for a refrigerator.

2. Description of the Conventional Art

As shown in FIG. 1, a conventional freezing cycle apparatus includes a compressor 1 for changing a gaseous refrigerant of a low temperature and pressure to a high temperature and pressure gaseous refrigerant, an condenser 2 for changing the thusly changed high temperature and pressure gaseous refrigerant to a high temperature and pressure liquid state refrigerant which acts and radiating heat to the outside of the refrigerator, a capillary tube 3 for changing the liquid state refrigerant into a low temperature and pressure liquid refrigerant, an evaporator 4 for changing the liquid state refrigerant which is changed to a low temperature and pressure by the capillary tube 3 to a gaseous state refrigerant, thus absorbing external heat, and a refrigerant tube 5 connecting the condenser 1, the compressor 2, the capillary tube 3, and the evaporator 4, respectively.

The above-described refrigerating cycle is generally adapted to a refrigerator or an air conditioner and is directed to storing foods in a fresh state and conditioning an indoor environment by cooling or heating the indoor air by installing the evaporator 4 which absorbs an external heat and the compressor, which 2 externally radiates the thusly absorbed heat.

The refrigerating cycle may have a quick freezing or quick thawing function. The quick freezing and quick thawing function will be explained in more detail with reference to FIG. 2. In a refrigerator having a fan 11 and an evaporator 12 which are installed behind a grill fan (not shown) in a freezing chamber 10, in the quick freezing mode of the conventional refrigerator, as shown in FIG. 3, the air cooled by the evaporator 12 is introduced into the freezing chamber 10 forcibly by the fan 11. The thusly introduced cooled air flows toward the evaporator 12 through the paths formed in the refrigerating chamber 10.

Namely, a damper 14 for the freezing chamber 15 is operated by a selection switch (not shown) or a selection button (not shown). When the damper 14 is closed, the cooled air flowing into the refrigerating chamber 15 is blocked, and only the freezing chamber 10 is operated.

However, in the freezing cycle of the conventional quick freezing refrigerator which is operated identically to a state that the refrigerator is normally operated, since a damper is installed in the refrigerator for controlling the amount of refrigerant, thus operating only the freezing chamber. Therefore, 3 (three) hours are required for the quick freezing operation, assuming that a standard test package having a thickness of 5 cm and a weight of 500 g is used for attempting to decrease a temperature from −5° C to −1° C. within 30 minutes. Therefore, it is impossible to actually enable a quick freezing operation within 30 minutes which is required for fully preventing the expansion of a water molecular structure contained in the food to be frozen.

In addition, the conventional apparatus which is configured to include a quick freezing and quick thawing cycle will now be explained.

First, the cycle of the conventional freezing cycle apparatus having a quick thawing function will now be explained with reference to FIG. 4 which is performed as follows: the compressor 1 --> the condenser 2 --> a first capillary tube 3 --> an opening/closing valve 8 --> a main evaporator 4 --> a check valve 9 --> a compressor 1, so that the common freezing function is performed. Here, a first cycle is defined as one circulation during which the common refrigerating function is performed once.

At this time, a second capillary tube 7 is connected between the first capillary tube 3 and the opening/closing valve 8, and an auxiliary evaporator 6 is connected with one end of the second capillary tube 7.

The other end of the auxiliary evaporator 6 is connected between the compressor 1 and the check valve 9.

The quick freezing cycle of the freezing cycle apparatus having a quick freezing function is performed as follows: the compressor 1 --> the condenser 2 --> the first capillary tube 3 --> the second capillary tube 7 --> the auxiliary evaporator 6 --> the compressor 1, thus performing the quick freezing function.

At this time, the refrigerant which became a low temperature and pressure by the first capillary tube 3 passes through the second capillary tube 7, and the pressure thereof is decreased thereby, and then the refrigerant passes through the auxiliary evaporator 6, so that the quick freezing function (here, the cycle of performing the quick freezing function is called as a second cycle) is performed.

However, when performing a quick freezing operation using the freezing cycle apparatus having a conventional quick freezing function, since the refrigerant does not flow to the main evaporator, when the apparatus is operated for more than a predetermined time, the temperature of the interiors of the freezing chamber and refrigerating chamber in which the main evaporator is installed is increased.

In addition, the cycle of the freezing cycle apparatus having a conventional quick thawing function is performed as follows: the compressor 1 --> a three-way valve 8 --> the condenser 2 --> the check valve 9 --> the first capillary tube 3 --> the evaporator 4 --> the compressor 1, for thus performing a common freezing function.

During the freezing cycle, the gaseous refrigerant is changed to a liquid state refrigerant by the condenser 2, thus radiating heat to the output side of the refrigerator.

At this time, in order to perform the quick thawing function, an auxiliary condenser 6 is connected with the three-way valve 8 for performing a quick thawing function. The second capillary tube 7 is connected with an end portion of the auxiliary condenser 6, and the other end of the second capillary tube 7 is connected between the check valve 9 and the first capillary tube 3.

The quick thawing cycle of the freezing cycle apparatus having a conventional quick thawing function is performed as follows: the compressor 1 --> the three-way valve 8 --> the auxiliary condenser 6 --> the second capillary tube 7 --> the first capillary tube 3 --> the main evaporator 4 --> the compressor 1, for thus performing a quick thawing function (here, the above-described cycle is called as a third cycle in which the quick thawing cycle is performed).

However, as described above, in order to concurrently perform the quick freezing and quick thawing operations, an additional cycle should be disadvantageously performed.

SUMMARY OF THE INVENTION

Accordingly, it is an object of the present invention to provide a freezing cycle apparatus having quick freezing and thawing functions which overcomes the aforementioned problem encountered in the conventional art.

It is another object of the present invention to provide an improved freezing cycle apparatus having quick freezing and thawing functions which is capable of selectively performing a function between a quick freezing function and a quick thawing function by collectively forming a freezing/thawing function.

It is another object of the present invention to provide an improved freezing cycle apparatus having quick freezing and thawing functions which is capable of implementing a quick freezing function of foods using an auxiliary evaporator installed in a freezing cycle apparatus, dividing a freezing chamber of the refrigerator into a quick freezing chamber and a common refreezing chamber, and using the thusly divided quick freezing chamber.

To achieve the above objects, there is provided a freezing cycle apparatus having quick freezing and thawing functions which includes a compressor, a threeway valve connected with one end of the compressor, condenser connected with one end of the three-way valve, a phase separator connected with one end of the condenser, a first capillary tube connected with one end of the phase separator, a first check valve connected with one end of the first capillary tube, a common freezing unit one end of which is connected with the first check value and the other end of which is connected with the other end of the compressor, which is comprised of a main evaporator, and a quick freezing and thawing function unit connected with the common freezing unit and including an auxiliary heat exchanger, a plurality of capillary tubes, an opening/closing valve, and a check valve.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The freezing cycle apparatus having a quick freezing/thawing function according to a first embodiment of the present invention will now be explained with reference to the accompanying drawings.

Figure 1:
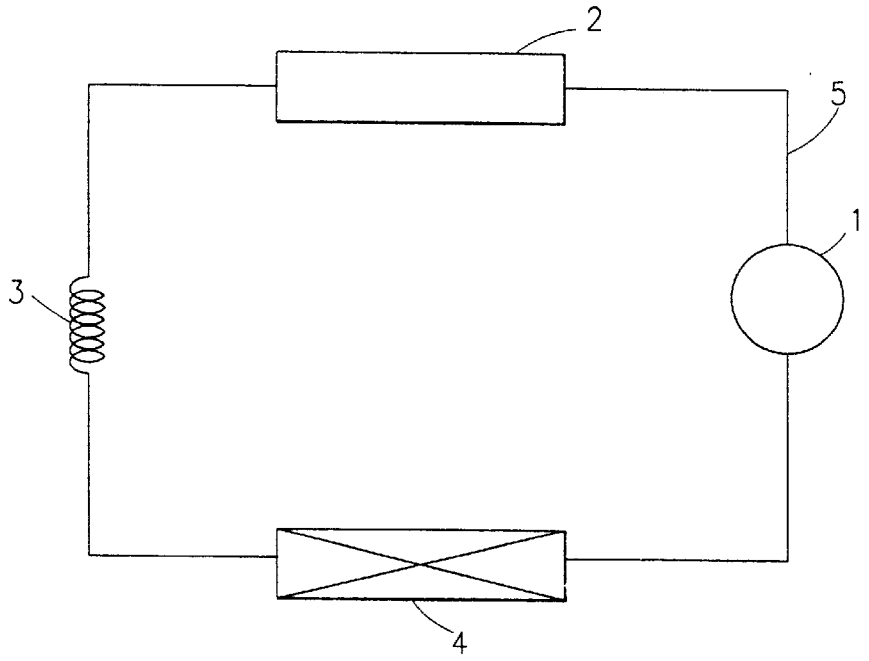
FIG. 1 CONVENTIONAL ART
FIG. 1 is a schematic view illustrating a conventional freezing cycle apparatus.
Figure 2:
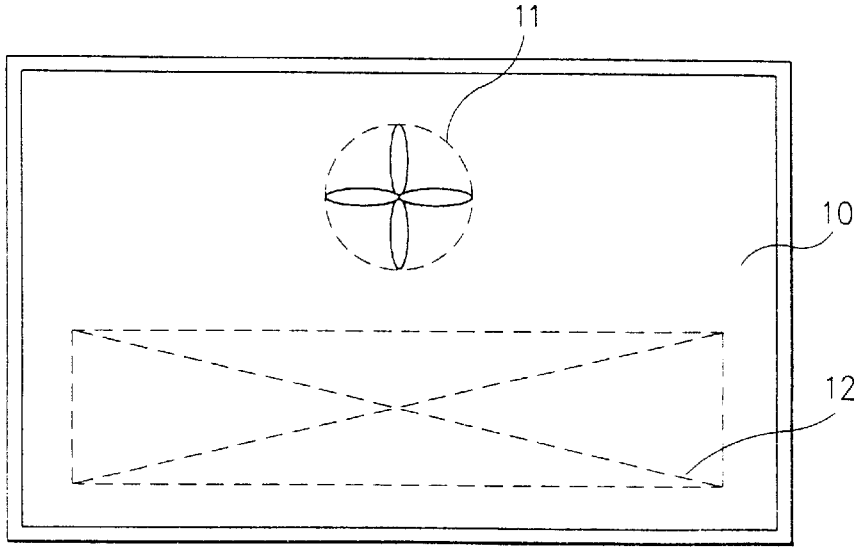
FIG. 2 CONVENTIONAL ART
FIG. 2 is a front view illustrating a freezing chamber of a conventional refrigerator.
Figure 3:
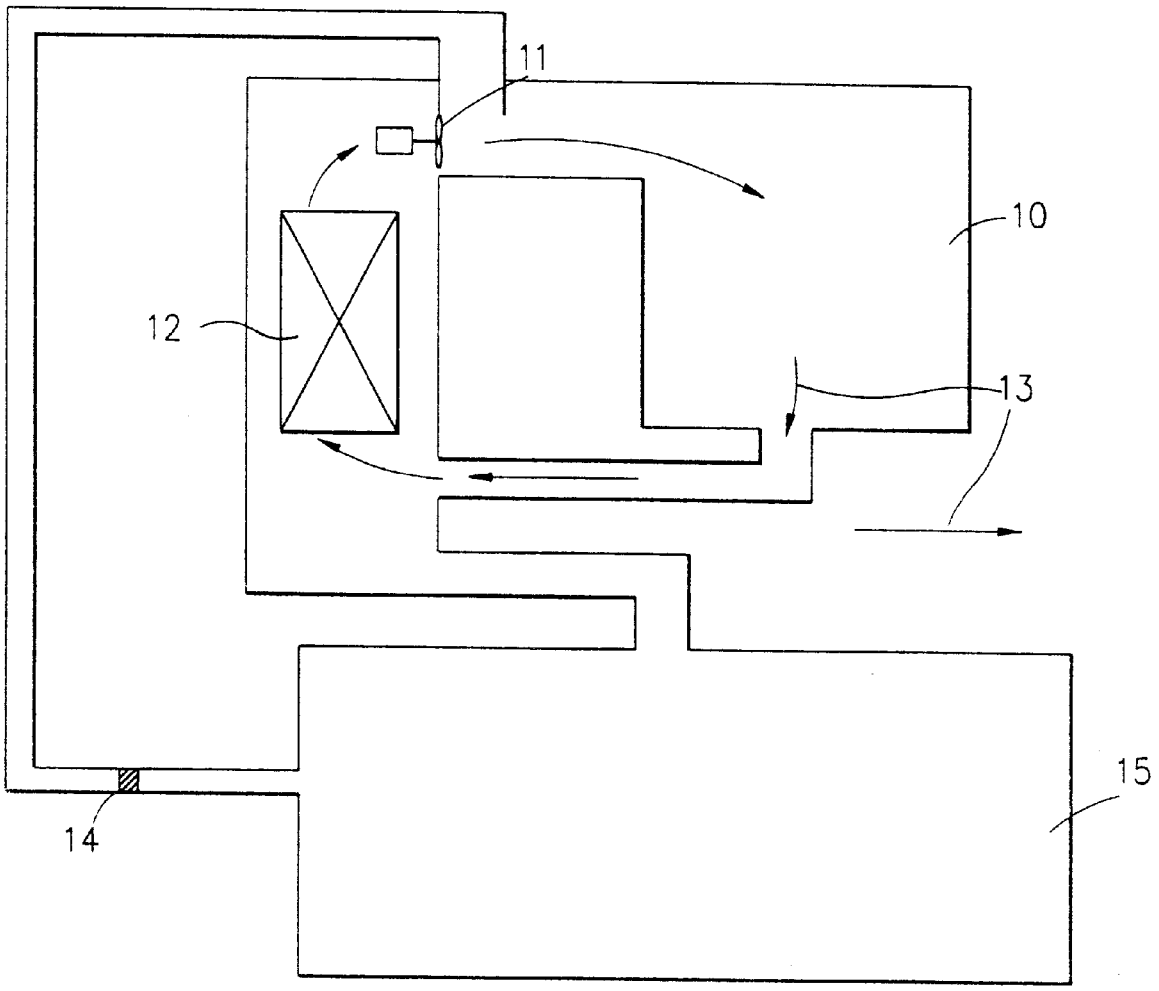
FIG. 3 CONVENTIONAL ART
FIG. 3 is a schematic view illustrating a cooled air flow path in a conventional refrigerator.
Figure 4:
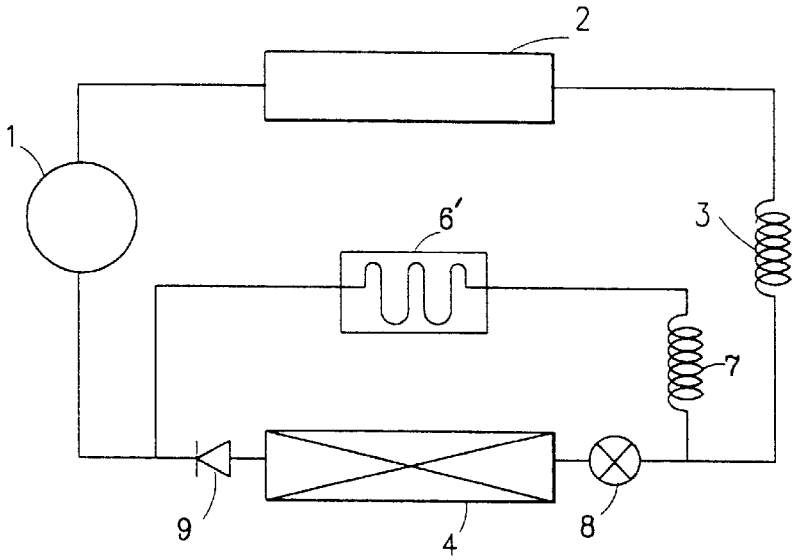
FIG. 4 CONVENTIONAL ART
FIG. 4 is a schematic view illustrating a conventional freezing cycle apparatus having a freezing function and a quick thawing function.
Figure 5:
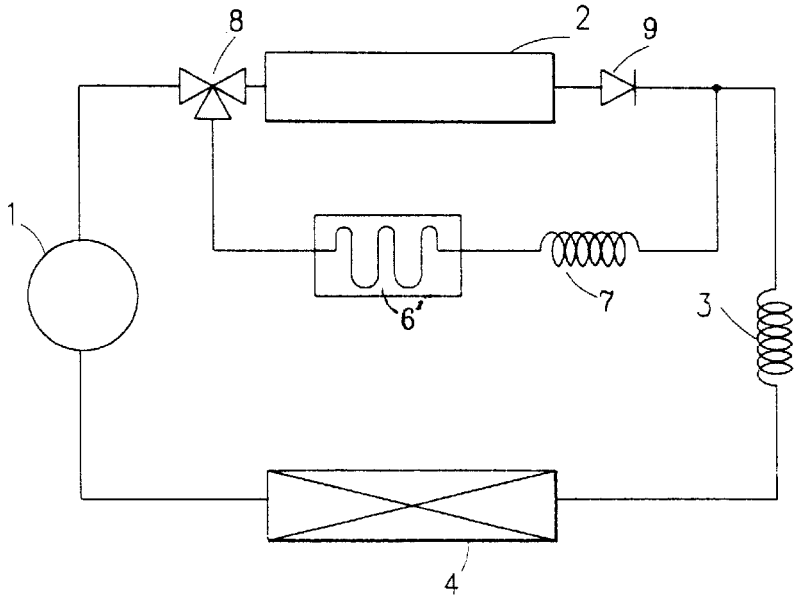
FIG. 5 CONVENTIONAL ART
FIG. 5 is a schematic view illustrating another conventional freezing cycle apparatus having a freezing function and a quick thawing function.
Figure 6A:
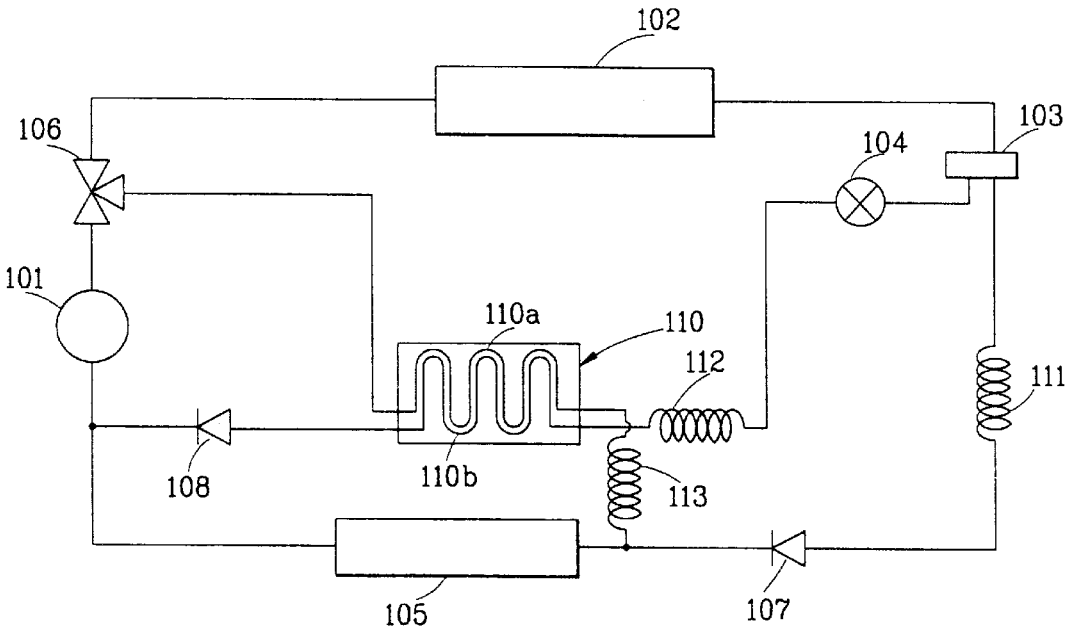
FIG. 6A is a schematic view illustrating a freezing cycle apparatus having quick freezing and thawing functions according to a first embodiment of the present invention.

As shown in FIG. 6A, in the freezing cycle apparatus having a quick freezing/thawing function according to the present invention, a three-way valve 106 is connected with one end of a compressor 101, and a main condenser 102 is connected with one end of the three-way valve 106, and a phase separator 103 is connected with the main condenser 102.

In addition, a first capillary tube 111 is connected with one end of the phase separator 103, and a first check valve 107 is connected with one end of the first capillary tube 111.

One end of a main evaporator 105 is connected with the other end of the compressor 101, thus forming a first cycle.

Here, the connection tubes of each element are called as a refrigerant tube 109.

In addition, an opening/closing valve 104 is connected with the phase separator 103, and a second capillary tube 112 is connected with the opening/closing valve 104. A cooling tube 110*b* which is one element of an auxiliary heat exchanger 110 is connected with the second capillary tube 112. A second is check valve 108 is connected with the cooling tube 110*b*, and one end of the second check valve 108 is connected with the compressor 101 for thus forming a second cycle.

The above-described second cycle is performed as follows: the compressor 101 --> the three-way valve 106 --> the main condenser 102 --> the phase separator 103 --> the opening/closing valve 104 --> the second capillary tube 112 --> the cooling tube 110*b* --> the second check valve 108 --> the compressor 101.

In addition, a third capillary tube 113 connected between the main evaporator 105 and the first check valve 107 is connected with a heating tube 110*a* which is extended from the three-way valve 106 and forms a part of the auxiliary heat exchanger 110 for thus forming a third cycle.

The thusly configured third cycle is operated as follows: the compressor 101 --> the three-way valve 106 --> the heating tube 110*a* of the auxiliary heat exchanger 110 --> the third capillary tube 113 --> the main evaporator 105 --> the compressor 101.

At this time, the auxiliary heat exchanger including the cooling tube 110*b* and the heating tube 110*a* is implemented by a direct cooling method.

The operation of the freezing cycle apparatus having a quick refrigerating and thawing function will now be explained with reference to the accompanying drawings.

Figure 6B:
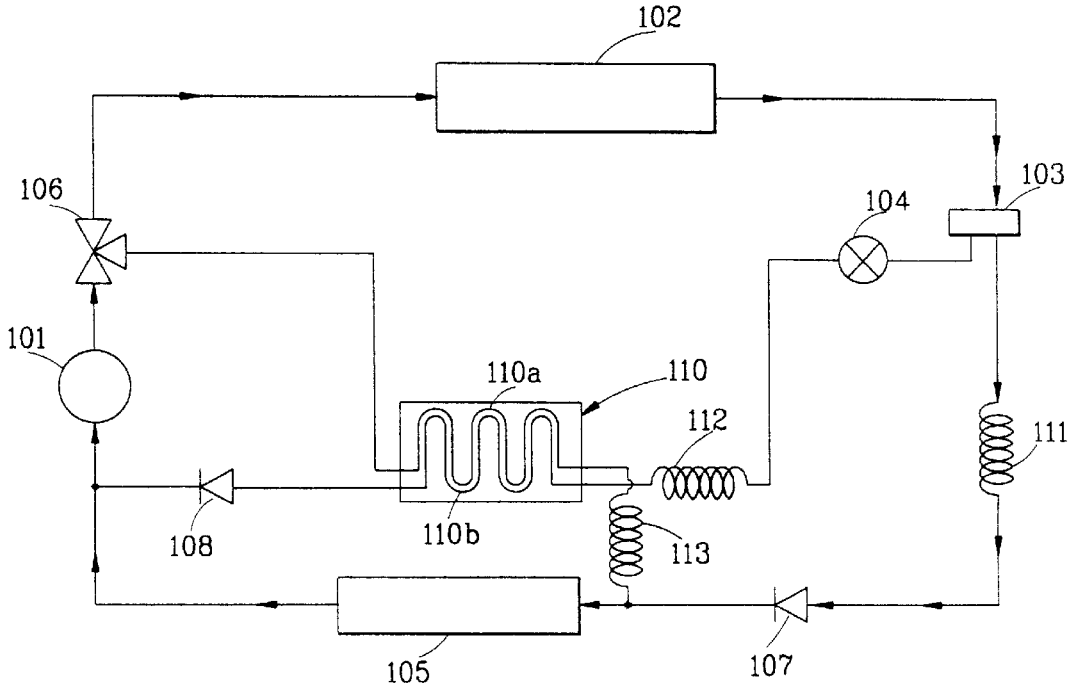
FIG. 6B is a schematic view illustrating a cooled air flow path in the common freezing mode of a freezing cycle apparatus according to a first embodiment of the present invention.

First, when the freezing cycle apparatus having a quick cooling/thawing function performs a common freezing operation, as shown in FIG. 6B, the refrigerant gas which become a high temperature and pressure state by the compressor 101 passes through the three-way valve 106, radiates heat, and passes through the phase separator 103.

In addition, the high temperature and pressure liquid refrigerant passed through the phase separator 103 becomes a low temperature and pressure liquid refrigerant by the first capillary tube 111.

As the liquid refrigerant passed through the first capillary tube 111 passes through the first check valve 107 and the main evaporator 105, the liquid refrigerant absorbs heat and is changed to a gaseous refrigerant. The gaseous refrigerant passed through the main evaporator 105 is introduced into the compressor 101 for thus forming a first cycle.

The cooled air heat-exchanged by the main evaporator 105 during the above-described circulation acts to maintain a predetermined temperature level in the refrigerator.

Figure 6C:
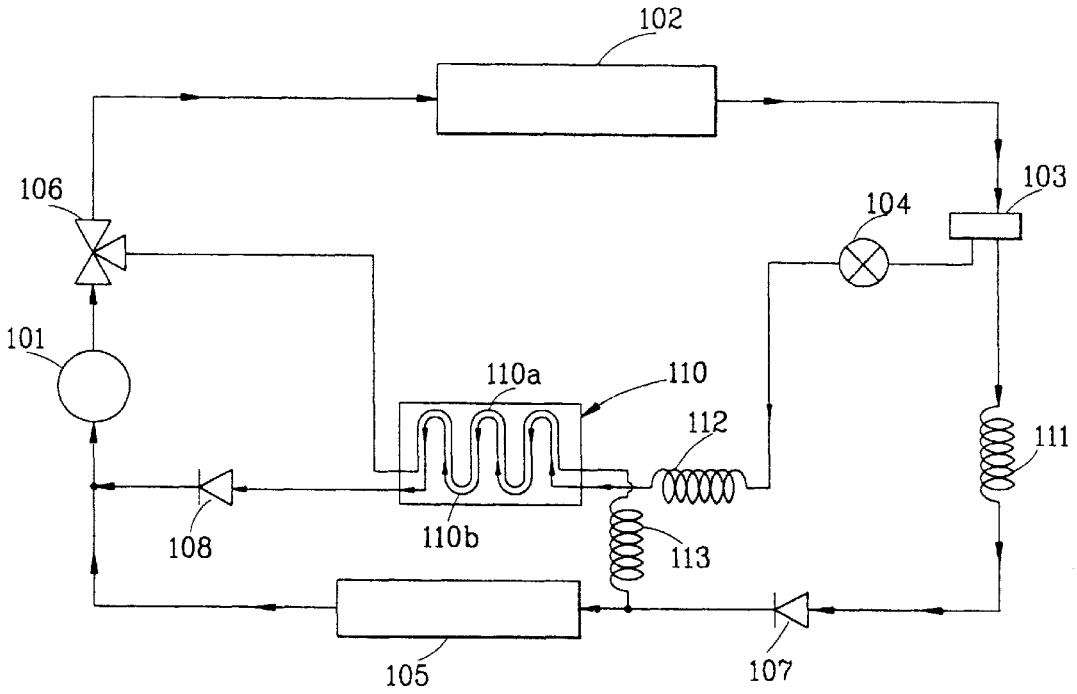
FIG. 6C is a schematic view illustrating a cooled air flow direction in the quick freezing mode of a freezing cycle apparatus according to a first embodiment of the present invention.

In addition, when the freezing cycle apparatus having a quick freezing and thawing function according to the present invention is operated in the quick freezing mode, as shown in FIG. 6C, in a state that the opening/closing valve 104 is opened, the gaseous refrigerant which attains a high temperature and pressure state by the compressor 101 passes through the three-way valve 106 and the main condenser 102, respectively.

A part of the refrigerant passed through the three-way valve 106 and the main evaporator 102 passes through the phase separator 103 and then sequentially passes through the opening/closing valve 104, the second capillary tube 112, the cooling tube 110*b*, and the second check valve 108 and is introduced into the compressor 101 for thus forming a second cycle.

A part of the refrigerant passed trough the main condenser 102 passes trough the phase separator 103 and then sequentially passes through the first capillary tube 111, the first check valve 107, and the main evaporator 105 and is introduced into the compressor 101 for thus forming a first cycle.

In the quick freezing cycle according to the present invention, the first and second cycles are concurrently performed. At this time, the direct cooling method and indirect cooling method are concurrently performed by the cooling tube 110*b* of the auxiliary heat exchanger 110 and the main evaporator 105.

Figure 6D:
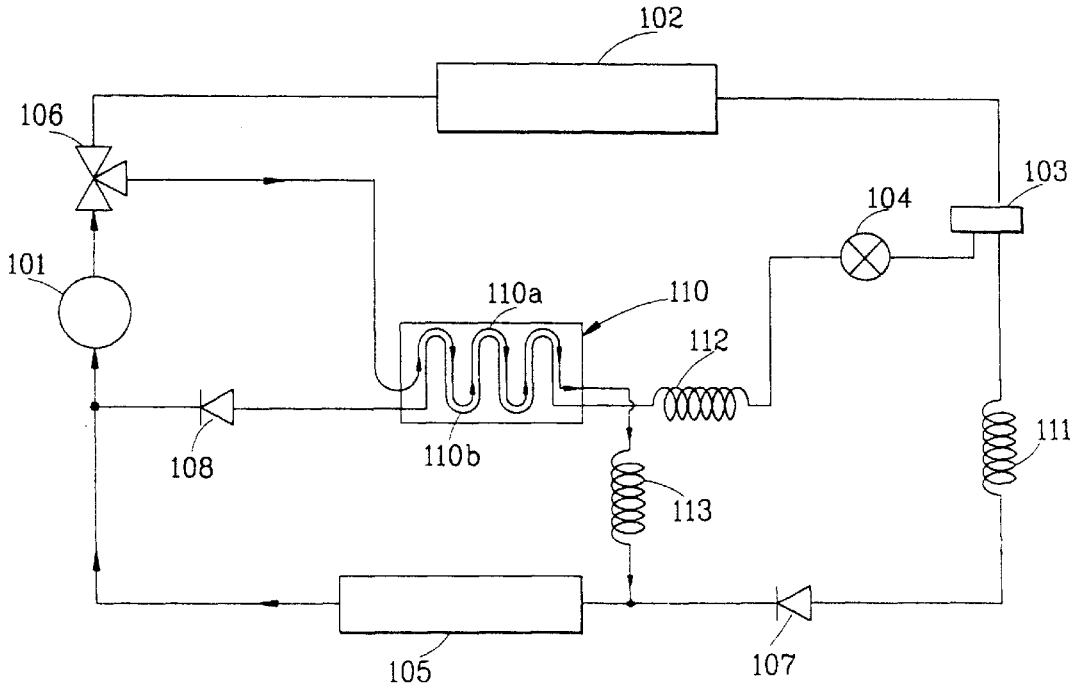
FIG. 6D is a schematic view illustrating a cooled air flow direction in the thawing mode of a freezing cycle apparatus according to a first embodiment of the present invention.

In the quick thawing mode of the freezing cycle apparatus having a quick cooling and thawing function according to the present invention, as shown in FIG. 6D, in a state that the opening/closing valve 104 is closed, the gaseous refrigerant which attain a high temperature and pressure state by the compressor 101 sequentially passes through the three-way valve 106, the heating tube 110*a* of the auxiliary heat exchanger 110, the second capillary tube 112, and the main evaporator 105 and is introduced into the compressor 101 for thus forming a third cycle.

At this time, the quick thawing function is performed by heat generated by the heating tube 110*a* in the auxiliary heat exchanger 110. This quick thawing operation is performed by directly contacting the foods to be thawed to a predetermined portion of the auxiliary heat exchanger 110.

The first check valve 107 connected between the first capillary tube 111 and the main evaporator 105 prevents the refrigerant from flowing toward the first capillary tube 111, respectively, during the third cycle in the quick thawing mode.

In addition, the second check valve 108 installed between the cooling tube 110*b* and the compressor 101 prevents the temperature of the cooling tube 110*b* from being increased up to about 30° C.

The freezing cycle apparatus having a quick freezing and thawing function according to a second embodiment of the present invention will now be explained with reference to the accompanying drawings.

Figure 7:
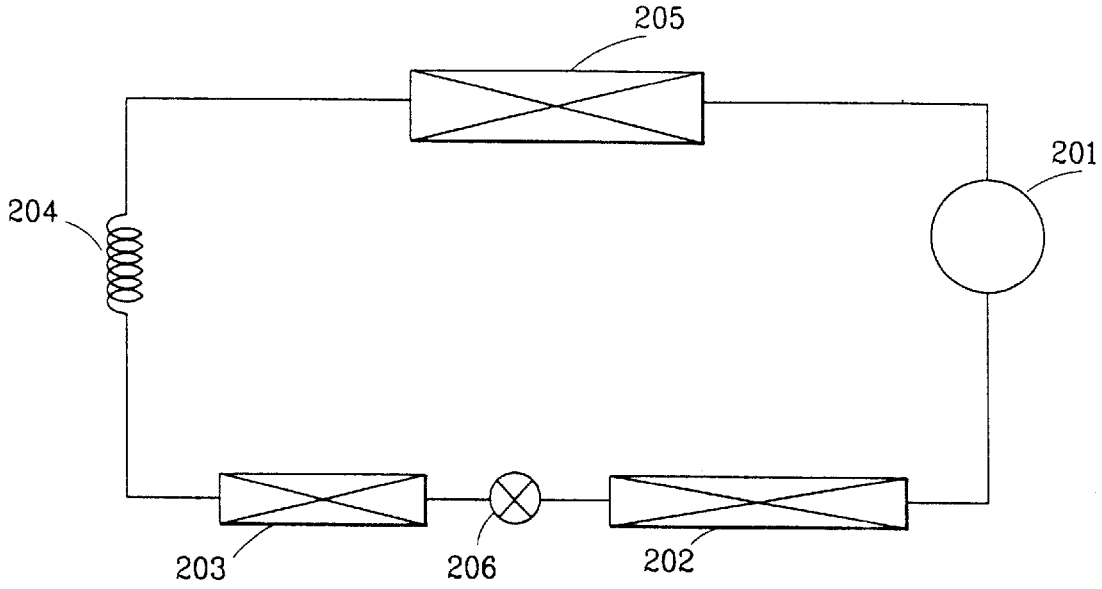
FIG. 7 is a schematic view illustrating a freezing cycle apparatus having a quick freezing function according to a second embodiment of the present invention.

In the cycle apparatus according to the second embodiment of the present invention, as shown in FIG. 7, a main evaporator 202 is connected with a compressor 201, and an opening/closing valve 206 is connected with the main evaporator 202.

Figure 8:
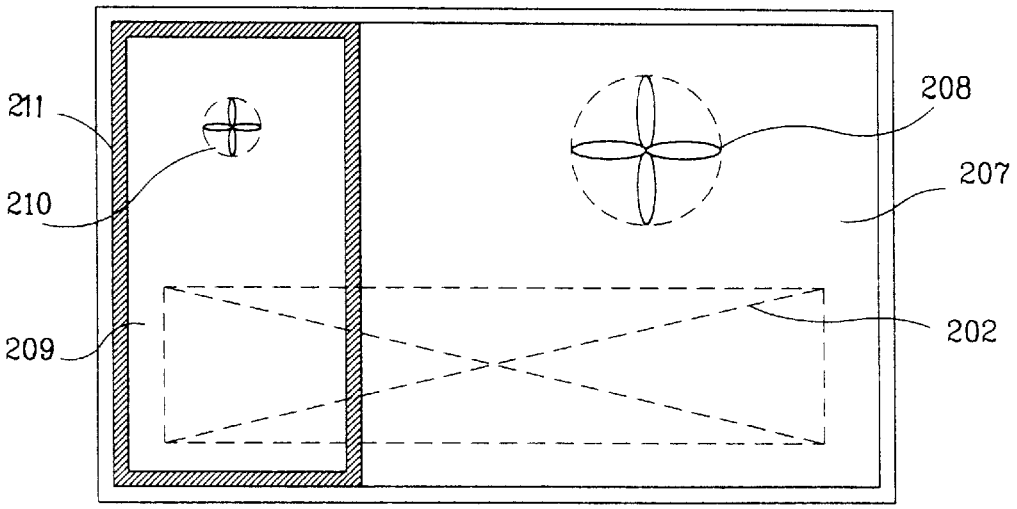
FIG. 8 is a front view illustrating a freezing chamber of a refrigerator having a quick freezing function according to a second embodiment of the present invention.
Figure 9:
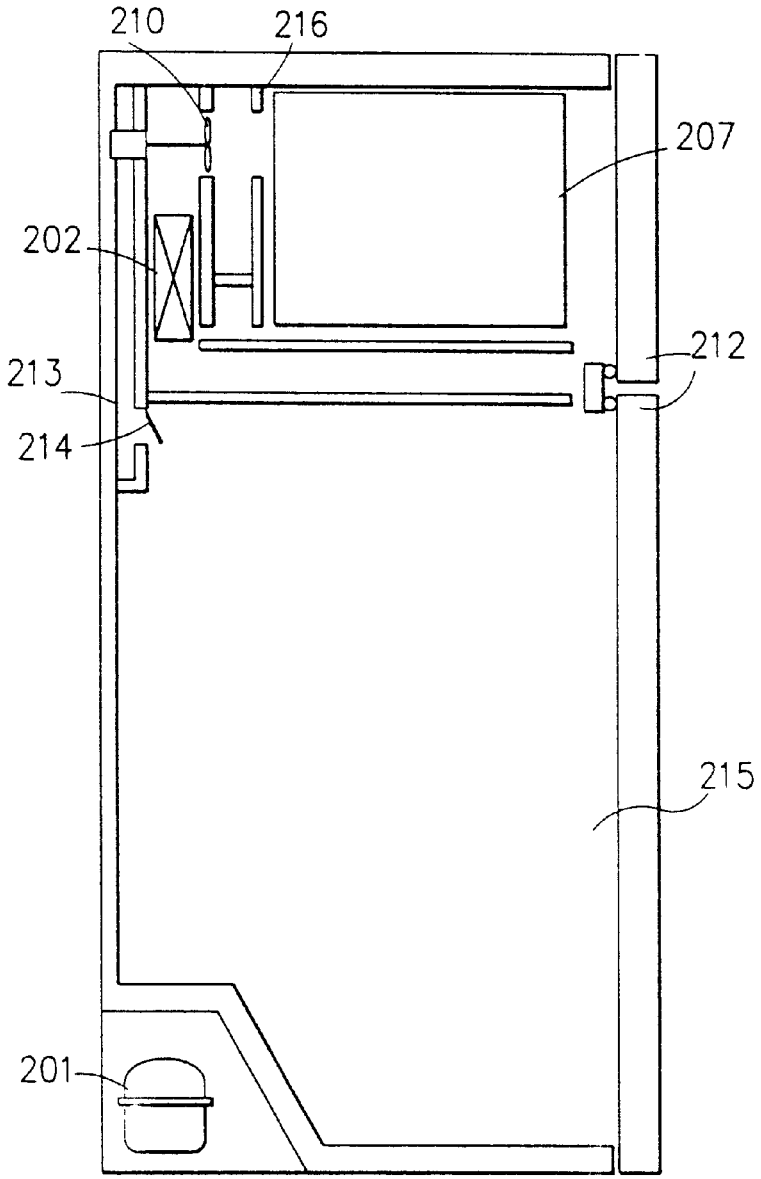
FIG. 9 is a left cross-sectional view illustrating of a refrigerator having a quick freezing function according to a second embodiment of the present invention.

In addition, an auxiliary evaporator 203 is connected with one end of the auxiliary evaporator 203, and a capillary tube 204 is connected with the other end of the auxiliary evaporator 203. The capillary tube 204 is connected with an condenser 205. The condenser 205 is connected with the compressor 201. The construction of the freezing chamber according to a second embodiment of the present invention will now be explained with reference to FIGS. 8 and 9.

The freezing chamber of the freezing cycle apparatus having a quick and thawing function according to a second embodiment of the present invention is divided into a quick freezing chamber 209 and a common freezing chamber 207. An auxiliary fan 210 and an auxiliary evaporator 211 are installed in the quick freezing chamber 209.

In addition, the main evaporator 202 and the auxiliary evaporator 211 are connected in series with each other, and the opening/closing valve 206 is connected between the main evaporator 202 and the auxiliary evaporator 211.

The operation of the second embodiment of the present invention will now be explained with reference to FIG. 10.

Figure 10:
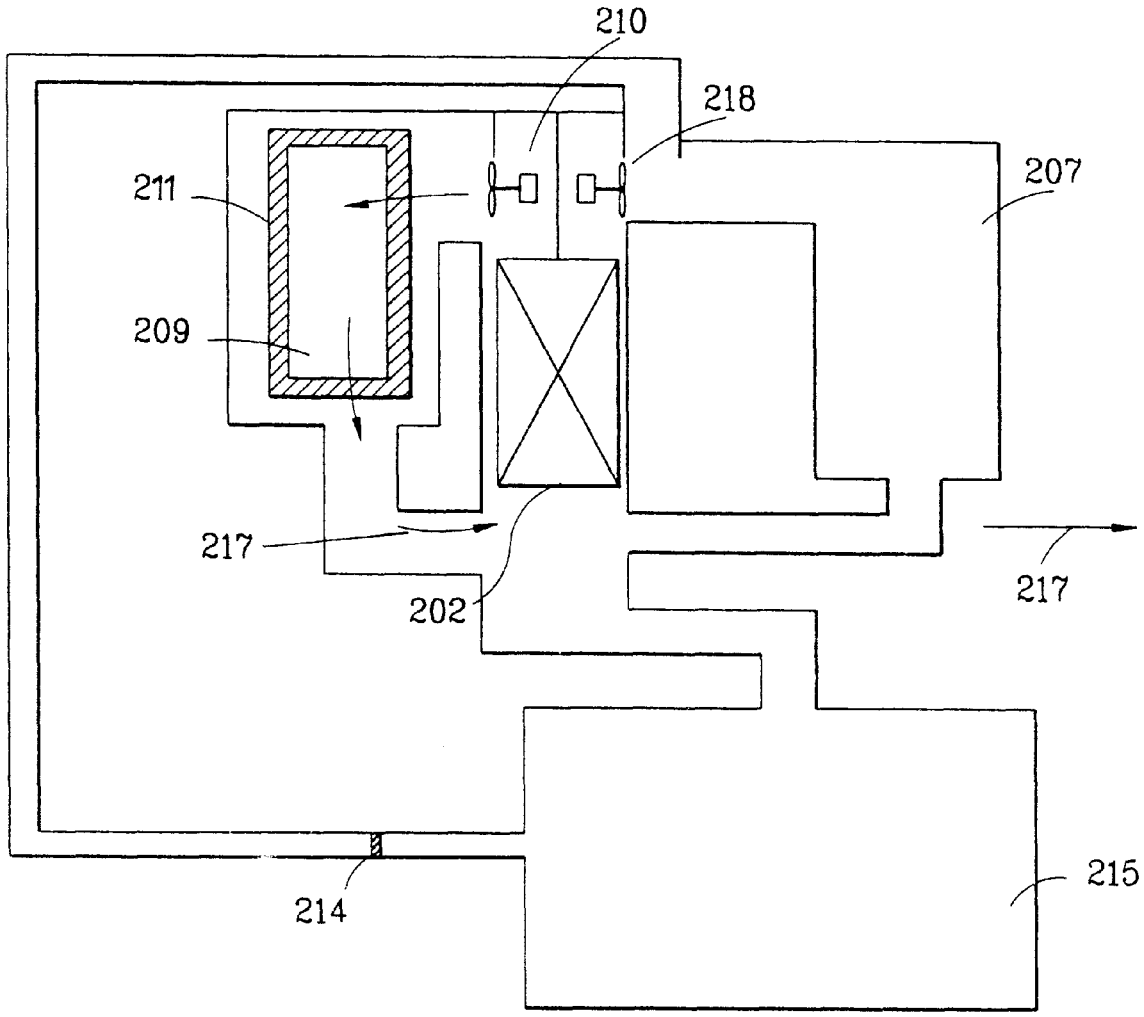
FIG. 10 is a schematic view illustrating a cooled air flow path of a refrigerator having a quick freezing function according to a second embodiment of the present invention.

As shown in FIG. 10, the cooling air flows through the paths as shown in FIG. 10. The auxiliary fan 210 installed in the freezing chamber which is divided into the quick freezing chamber 209 and the common freezing chamber 207 is operated, and the cooling air from the main evaporator 202 flows into only the quick freezing chamber 209. At this time, a main fan 208 is not operated. The auxiliary evaporator 211 is made of a direct contact type heat exchanger made of aluminum, namely, it is made of a direct cooling plate, and surrounds the quick freezing chamber 209, whereby the foods are quickly frozen by a good heat conductivity.

At this time, as the main fan 208 is stopped, the cooling air introduction into the common freezing chamber 207 is blocked by the insulation material, and the cooling air introduction into a refrigerating chamber 215 is blocked by a refrigerating chamber damper 214. The damper 214 is operated by a selection switch or a selection button in the quick freezing mode. In addition, the damper 214 may be automatically operated by a microcomputer sensor installed in the refrigerator when there is a predetermined temperature variation in the refrigerator, preferably maintaining a temperature of 3° C. in the refrigerating chamber and a temperature of −18° C. in the freezing chamber.

The quick freezing operation in the quick freezing chamber is implemented by a forcible circulation of the cooing air from the main evaporator 202 using the auxiliary fan 210 and a heat conductivity by the auxiliary evaporator 211 which is made of a direct cooling type plate.

When performing the common refrigerating function according to the second embodiment of the present invention, the auxiliary fan 210 is stopped. Namely, only the main fan 208 is operated for thus performing the common refrigerating function.

In the freezing cycle apparatus having a quick/thawing function according to the present invention, in order to transfer a part of the cooling air into the freezing chamber and refrigerating chamber in the freezing function mode, a part of the cooling air may be transferred into the refrigerating chamber and freezing chamber by using a temperature sensor. Additionally, it is possible to transfer the cooling air thereinto by periodically operating the main fan or opening the refrigerating chamber damper.

As described above, in the freezing cycle apparatus having a quick freezing and thawing function according to the present invention, it is possible to selectively perform a quick freezing function and a quick thawing function using one cycle apparatus.

In addition, it is possible to prevent the temperature in the interior of the refrigerating chamber, in which the quick freezing and evaporator is installed, from being increased by providing an auxiliary heat exchanger of a direct freezing method and a main evaporator of an indirect freezing method in the quick freezing mode, whereby it is possible to freshly store the foods.

Furthermore, it is possible to maintain the quick freezing time to be within 30 minutes by improving the freezing cycle apparatus, whereby it is possible to prevent the foods from being rotten due to the breakage of cell structure of the foods.

Although the preferred embodiment of the present invention has been disclosed for illustrative purposes, those skilled in the art will appreciate that various modifications, additions and substitutions are possible, without departing from the scope and spirit of the invention as recited in the accompanying claims.

What is claimed is:

1. A freezing cycle apparatus having a quick freezing and thawing function, comprising:

a compressor;

a three-way valve connected with one end of the compressor;

a main condenser connected with one end of the three-way valve;

a phase separator connected with one end of the main condenser;

a first capillary tube connected with one end of the phase separator;

a first check valve connected with one end of the first capillary tube;

a common freezing device one end of which is connected with the first check valve and the other end of which is connected with the other end of the compressor, which is comprised of a main evaporator; and a quick freezing and thawing facility connected with the common freezing device and including an auxiliary heat exchanger, a plurality of capillary tubes, an opening/closing valve, and a check valve.

2. The apparatus of claim 1, wherein said quick freezing and thawing facility includes:

a quick freezing device one end of which is connected with the other end of the phase separator and the other end of which is connected between the main evaporator and the compressor, said quick freezing device including an auxiliary heat exchanger having a cooling tube; and a quick thawing device one end of which is extended from the three-phase valve and the other end of which is connected between the first check valve and the main evaporator, said quick thawing device including a heat exchanger having a heating tube.

3. The apparatus of claim 2, wherein said quick freezing device includes:

a check valve connected between the main evaporator and the compressor;

the cooling tube of an auxiliary heat exchanger connected with one end of the check valve;

a capillary tube connected with one end of the cooling tube of the auxiliary heat exchanger; and an opening/closing valve one end of which is connected with one end of the capillary tube, and the other of which is connected with the other end of the phase separator.

4. The apparatus of claim 2, wherein said quick thawing device includes:

the heating tube of the auxiliary heat exchanger extended from the three-way valve; and a capillary tube one end of which is connected with one end of the heating tube of the auxiliary heat exchanger, and the other end of which is connected between the first check valve and the main evaporator.

5. The apparatus of claim 3, wherein said cooling tube of the auxiliary heat exchanger is configured by a direct cooling method.

6. The apparatus of claim 4, wherein said heating tube of the auxiliary heat exchanger is configured by a direct cooling method.

7. The apparatus of claim 1, wherein said quick freezing and thawing device includes:

a freezing chamber in which a quick freezing chamber is formed in one side and a main fan is installed in another side, an auxiliary fan being installed inside the quick freezing chamber;

a refrigerating chamber formed below the freezing chamber;

said compressor;

said main evaporator connected with one end of the compressor;

an opening/closing valve connected with one end of the main evaporator;

an auxiliary evaporator one end of which is connected with one end of the opening/closing valve and another end of which is connected with the capillary tube, said auxiliary evaporator being installed in the quick freezing chamber; and a condenser one end of which is connected with one end of the capillary tube, and the other end of which is connected with the other end of the compressor.

8. The apparatus of claim 7, wherein a quick freezing operation in the quick chamber is implemented by the convection of cooled air generated by the main evaporator by the auxiliary fan, and a heat transfer of the auxiliary evaporator which is a direct cooling member.

9. The apparatus of claim 8, wherein a cooling air from the main evaporator is introduced into the freezing chamber when the auxiliary fan is operated, and is introduced into the refrigerating chamber when the main fan is operated.

10. The apparatus of claim 2, wherein said auxiliary heat exchanger includes a cooling tube for the quick freezing device and a heating tube for the quick thawing device.

* * * * *